US008011155B2

(12) United States Patent
Pervan

(10) Patent No.: US 8,011,155 B2
(45) Date of Patent: Sep. 6, 2011

(54) LOCKING SYSTEM FOR MECHANICAL JOINING OF FLOORBOARDS AND METHOD FOR PRODUCTION THEREOF

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 12/834,258

(22) Filed: Jul. 12, 2010

(65) Prior Publication Data

US 2010/0275546 A1 Nov. 4, 2010

Related U.S. Application Data

(63) Continuation of application No. 10/925,924, filed on Aug. 26, 2004, now Pat. No. 7,779,596, which is a continuation of application No. 10/256,167, filed on Sep. 27, 2002, now Pat. No. 6,898,913, which is a continuation of application No. 09/954,066, filed on Sep. 18, 2001, now Pat. No. 6,510,665, which is a continuation of application No. PCT/SE01/00125, filed on Jan. 24, 2001.

(30) Foreign Application Priority Data

Jan. 24, 2000 (SE) ..... 0000200

(51) Int. Cl.
*E04B 2/00* (2006.01)

(52) U.S. Cl. ..... 52/588.1; 52/390; 52/539; 52/582.2; 428/50

(58) Field of Classification Search ..... 52/578, 52/588.1, 592.1, 390, 392, 533, 534, 553, 52/582.1, 586.1, 586.2, 589.1, 590.2, 590.3, 52/591.1–591.5, 592.2, 592.4, 745.08, 745.19, 52/747.1, 747.11, 748.1, 748.11, 539; 403/334, 403/345, 364–368, 372, 375, 376, 381; 404/34, 404/35, 40, 41, 46, 47, 49–58, 68, 70; 428/44, 428/47–50, 57, 58, 60, 61, 106, 192–194
See application file for complete search history.

(56) References Cited

U.S. PATENT DOCUMENTS 213,740 A 4/1879 Conner
(Continued)

FOREIGN PATENT DOCUMENTS

AT 218725 12/1961
(Continued)

OTHER PUBLICATIONS

U.S. Appl. No. 11/806,478, Pervan.
(Continued)

*Primary Examiner* — Eileen Lillis
*Assistant Examiner* — William V Gilbert
(74) *Attorney, Agent, or Firm* — Buchanan Ingersoll & Rooney P.C.

(57) ABSTRACT

A locking system for mechanical joining of floorboards (1, 1') which have a body (30), a lower balancing layer (34) and an upper surface layer (32). A strip (6) is integrally formed with the body (30) of the floorboard (1) and extends under an adjoining floorboard (1'). The strip (6) has a locking element (8), which engages a looking groove (14) in the underside of the adjoining floorboard (1') and forms a horizontal joint. A tongue (38) and a tongue groove (36) form a vertical joint between upper and lower plane-parallel contact surfaces (43, 45) and are designed in such manner that the lower contact surfaces (45) are on a level between the upper side of the locking element (8) and a plane containing the underside (3) of the floorboard. Also, a floorboard having such a locking system, a floor made of such floorboards, as well as a method for making such a locking system.

9 Claims, 7 Drawing Sheets

U.S. PATENT DOCUMENTS

| | | | | |
|---|---|---|---|---|
| 714,987 | A | | 12/1902 | Wolfe |
| 753,791 | A | | 3/1904 | Fulghum |
| 1,124,228 | A | | 1/1915 | Houston |
| 1,194,636 | A | | 8/1916 | Joy |
| 1,371,856 | A | | 3/1921 | Cade |
| 1,407,679 | A | | 2/1922 | Ruthrauff |
| 1,454,250 | A | | 5/1923 | Parsons |
| 1,468,288 | A | | 9/1923 | Een |
| 1,477,813 | A | | 12/1923 | Daniels et al. |
| 1,510,924 | A | | 10/1924 | Daniels et al. |
| 1,540,128 | A | | 6/1925 | Houston |
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,778,069 | A | | 10/1930 | Fetz |
| 1,787,027 | A | | 12/1930 | Wasleff |
| 1,790,178 | A | | 1/1931 | Sutherland |
| 1,809,393 | A | | 6/1931 | Rockwell |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,929,871 | A | | 10/1933 | Jones |
| 1,940,377 | A | | 12/1933 | Storm |
| 1,953,306 | A | | 4/1934 | Moratz |
| 1,986,739 | A | | 1/1935 | Mitte |
| 1,988,201 | A | | 1/1935 | Hall |
| 1,995,264 | A | | 3/1935 | Mason |
| 2,026,511 | A | | 12/1935 | Storm |
| 2,044,216 | A | | 6/1936 | Klages |
| 2,266,464 | A | | 12/1941 | Kraft |
| 2,276,071 | A | | 3/1942 | Scull |
| 2,324,628 | A | | 7/1943 | Kåhr |
| 2,398,632 | A | | 4/1946 | Frost et al. |
| 2,430,200 | A | * | 11/1947 | Wilson ..... 52/588.1 |
| 2,495,862 | A | | 1/1950 | Osborn |
| 2,740,167 | A | | 4/1956 | Rowley |
| 2,780,253 | A | | 2/1957 | Joa |
| 2,805,852 | A | | 9/1957 | Malm |
| 2,851,740 | A | | 9/1958 | Baker |
| 2,865,058 | A | | 12/1958 | Andersson et al. |
| 2,894,292 | A | | 7/1959 | Gramelspacher |
| 2,928,456 | A | | 3/1960 | Potchen et al. |
| 2,947,040 | A | | 8/1960 | Schultz |
| 3,045,294 | A | | 7/1962 | Livezey, Jr. |
| 3,100,556 | A | | 8/1963 | De Ridder |
| 3,120,083 | A | | 2/1964 | Dahlberg et al. |
| 3,125,138 | A | | 3/1964 | Bolenbach |
| 3,182,769 | A | | 5/1965 | De Ridder |
| 3,200,553 | A | | 8/1965 | Frashour |
| 3,203,149 | A | | 8/1965 | Soddy |
| 3,247,638 | A | | 4/1966 | Gay |
| 3,267,630 | A | | 8/1966 | Omholt |
| 3,282,010 | A | | 11/1966 | King, Jr. |
| 3,301,147 | A | | 1/1967 | Clayton et al. |
| 3,310,919 | A | | 3/1967 | Bue |
| 3,347,048 | A | | 10/1967 | Brown |
| 3,377,931 | A | | 4/1968 | Hilton |
| 3,387,422 | A | | 6/1968 | Wanzer |
| 3,460,304 | A | | 8/1969 | Braeuninger |
| 3,481,810 | A | | 12/1969 | Waite |
| 3,508,523 | A | | 4/1970 | De Meerleer |
| 3,526,420 | A | | 9/1970 | Brancalcone |
| 3,538,665 | A | | 11/1970 | Gohner |
| 3,548,559 | A | | 12/1970 | Levine et al. |
| 3,553,919 | A | | 1/1971 | Omholt |
| 3,555,762 | A | | 1/1971 | Costanza, Jr. |
| 3,579,941 | A | | 5/1971 | Tibbals |
| 3,694,983 | A | | 10/1972 | Couquet |
| 3,714,747 | A | | 2/1973 | Curran |
| 3,720,027 | A | | 3/1973 | Christensen |
| 3,729,368 | A | | 4/1973 | Ingham et al. |
| 3,731,445 | A | | 5/1973 | Hoffmann et al. |
| 3,759,007 | A | | 9/1973 | Thiele |
| 3,768,846 | A | | 10/1973 | Hensley et al. |
| 3,786,608 | A | | 1/1974 | Boettcher |
| 3,842,562 | A | | 10/1974 | Daigle |
| 3,857,749 | A | | 12/1974 | Yoshida |
| 3,859,000 | A | | 1/1975 | Webster |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,037,377 | A | | 7/1977 | Howell et al. |
| 4,084,996 | A | | 4/1978 | Wheeler |
| 4,090,338 | A | | 5/1978 | Bourgade |
| 4,099,358 | A | | 7/1978 | Compaan |
| 4,100,710 | A | | 7/1978 | Kowallik |
| 4,169,688 | A | | 10/1979 | Toshio |
| 4,196,554 | A | | 4/1980 | Anderson et al. |
| 4,227,430 | A | | 10/1980 | Jansson et al. |
| 4,242,390 | A | | 12/1980 | Nemeth |
| 4,299,070 | A | | 11/1981 | Oltmanns |
| 4,304,083 | A | | 12/1981 | Anderson |
| 4,426,820 | A | | 1/1984 | Terbrack |
| 4,471,012 | A | | 9/1984 | Maxwell |
| 4,489,115 | A | | 12/1984 | Layman et al. |
| 4,501,102 | A | | 2/1985 | Knowles |
| 4,561,233 | A | | 12/1985 | Harter et al. |
| 4,567,706 | A | | 2/1986 | Wendt |
| 4,612,074 | A | | 9/1986 | Smith et al. |
| 4,612,745 | A | | 9/1986 | Hovde |
| 4,641,469 | A | | 2/1987 | Wood |
| 4,643,237 | A | | 2/1987 | Rosa |
| 4,646,494 | A | | 3/1987 | Saarinen et al. |
| 4,648,165 | A | | 3/1987 | Whitehorne |
| 4,653,242 | A | | 3/1987 | Ezard |
| 4,703,597 | A | | 11/1987 | Eggemar |
| 4,715,162 | A | | 12/1987 | Brightwell |
| 4,716,700 | A | | 1/1988 | Hagemeyer |
| 4,738,071 | A | | 4/1988 | Ezard |
| 4,769,963 | A | | 9/1988 | Meyerson |
| 4,819,932 | A | | 4/1989 | Trotter, Jr. |
| 4,822,440 | A | | 4/1989 | Hsu et al. |
| 4,831,806 | A | | 5/1989 | Niese et al. |
| 4,845,907 | A | | 7/1989 | Meek |
| 4,905,442 | A | | 3/1990 | Daniels |
| 5,029,425 | A | | 7/1991 | Bogataj |
| 5,113,632 | A | | 5/1992 | Hanson |
| 5,117,603 | A | | 6/1992 | Weintraub |
| 5,148,850 | A | | 9/1992 | Urbanick |
| 5,165,816 | A | | 11/1992 | Parasin |
| 5,179,812 | A | | 1/1993 | Hill |
| 5,216,861 | A | | 6/1993 | Meyerson |
| 5,253,464 | A | | 10/1993 | Nilsen |
| 5,271,564 | A | | 12/1993 | Smith |
| 5,286,545 | A | | 2/1994 | Simmons, Jr. |
| 5,295,341 | A | | 3/1994 | Kajiwara |
| 5,349,796 | A | | 9/1994 | Meyerson |
| 5,390,457 | A | | 2/1995 | Sjölander |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,560,569 | A | | 10/1996 | Schmidt |
| 5,567,497 | A | | 10/1996 | Zegler et al. |
| 5,570,554 | A | | 11/1996 | Searer |
| 5,597,024 | A | | 1/1997 | Bolyard et al. |
| 5,613,894 | A | | 3/1997 | Delle VeDove |
| 5,618,602 | A | | 4/1997 | Nelson |
| 5,630,304 | A | | 5/1997 | Austin |
| 5,653,099 | A | | 8/1997 | MacKenzie |
| 5,671,575 | A | | 9/1997 | Wu |
| 5,695,875 | A | | 12/1997 | Larsson et al. |
| 5,706,621 | A | | 1/1998 | Pervan |
| 5,755,068 | A | | 5/1998 | Ormiston |

5,768,850 A 6/1998 Chen
5,797,237 A 8/1998 Finkell, Jr.
5,823,240 A 10/1998 Bolyard et al.
5,827,592 A 10/1998 Van Gulik et al.
5,860,267 A 1/1999 Pervan
5,899,038 A 5/1999 Stroppiana
5,900,099 A 5/1999 Sweet et al.
5,925,211 A 7/1999 Rakauskas
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,023,907 A 2/2000 Pervan
6,029,416 A 2/2000 Andersson
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,173,548 B1 1/2001 Hamar et al.
6,182,410 B1 2/2001 Pervan
6,203,653 B1 3/2001 Seidner
6,205,639 B1 3/2001 Pervan
6,209,278 B1 4/2001 Tychsen
6,216,403 B1 4/2001 Belbeoc'h
6,216,409 B1 4/2001 Roy et al.
6,247,285 B1 6/2001 Moebus
6,314,701 B1 11/2001 Meyerson
6,324,803 B1 12/2001 Pervan
6,332,733 B1 12/2001 Hamberger et al.
6,339,908 B1 1/2002 Chuang
6,345,481 B1 2/2002 Nelson
6,363,677 B1 4/2002 Chen et al.
6,385,936 B1 5/2002 Schneider
6,397,547 B1 6/2002 Martensson
6,421,970 B1 7/2002 Martensson et al.
6,438,919 B1 8/2002 Knauseder
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,526,719 B2 3/2003 Pletzer et al.
6,532,709 B2 3/2003 Pervan
6,536,178 B1 3/2003 Pålsson et al.
6,584,747 B2 7/2003 Kettler
6,591,568 B1 7/2003 Pålsson
6,601,359 B2 8/2003 Olofsson
6,606,834 B2 8/2003 Martensson et al.
6,647,689 B2 11/2003 Pletzer et al.
6,647,690 B1 11/2003 Martensson
6,670,019 B2 12/2003 Andersson
6,672,030 B2 1/2004 Schulte
6,684,592 B2 2/2004 Martin
6,715,253 B2 4/2004 Pervan
6,722,809 B2 4/2004 Hamberger et al.
6,763,643 B1 7/2004 Martensson
6,769,218 B2 8/2004 Pervan
6,769,219 B2 8/2004 Schwitte et al.
6,786,019 B2 9/2004 Thiers
6,851,241 B2 2/2005 Pervan
6,874,292 B2 4/2005 Moriau et al.
6,880,307 B2 4/2005 Schwitte et al.
6,898,913 B2 5/2005 Pervan
6,918,220 B2 7/2005 Pervan et al.
6,922,964 B2 8/2005 Pervan
6,933,043 B1 8/2005 Son et al.
7,003,925 B2 2/2006 Pervan
7,022,189 B2 4/2006 Delle VeDove
7,040,068 B2 5/2006 Moriau et al.
7,051,486 B2 5/2006 Pervan
7,121,059 B2 10/2006 Pervan
7,127,860 B2 10/2006 Pervan et al.
7,137,229 B2 11/2006 Pervan
7,171,791 B2 2/2007 Pervan
7,356,971 B2 4/2008 Pervan
7,444,791 B1 11/2008 Pervan
7,454,875 B2 11/2008 Pervan
7,516,588 B2 4/2009 Pervan
7,603,826 B1 10/2009 Moebus
7,637,068 B2 12/2009 Pervan
7,677,001 B2 3/2010 Pervan
7,739,849 B2 6/2010 Pervan
7,757,452 B2 7/2010 Pervan
2001/0029720 A1 10/2001 Pervan
2001/0034992 A1 11/2001 Pletzer et al.
2002/0007608 A1 1/2002 Pervan
2002/0014047 A1 2/2002 Thiers
2002/0020127 A1 2/2002 Thiers
2002/0031646 A1 3/2002 Chen et al.
2002/0046528 A1 4/2002 Pervan et al.
2002/0069611 A1 6/2002 Leopolder
2002/0083673 A1 7/2002 Kettler et al.
2002/0095894 A1 7/2002 Pervan
2002/0100231 A1 8/2002 Miller et al.
2002/0112433 A1 8/2002 Pervan
2002/0178673 A1 12/2002 Pervan
2002/0178674 A1 12/2002 Pervan
2002/0178682 A1 12/2002 Pervan
2003/0009972 A1 1/2003 Pervan et al.
2003/0024199 A1 2/2003 Pervan et al.
2003/0024200 A1 2/2003 Moriau et al.
2003/0041545 A1 3/2003 Stanchfield
2003/0084636 A1 5/2003 Pervan
2003/0101674 A1 6/2003 Pervan et al.
2003/0101681 A1 6/2003 Tychsen
2003/0115812 A1 6/2003 Pervan
2003/0115821 A1 6/2003 Pervan
2003/0196405 A1 10/2003 Pervan
2003/0221387 A1 12/2003 Shah
2003/0233809 A1 12/2003 Pervan
2004/0016196 A1 1/2004 Pervan
2004/0035078 A1 2/2004 Pervan
2004/0035079 A1 2/2004 Evjen
2004/0068954 A1 4/2004 Martensson
2004/0139678 A1 7/2004 Pervan
2004/0177584 A1 9/2004 Pervan
2004/0206036 A1 10/2004 Pervan
2004/0241374 A1 12/2004 Thiers et al.
2004/0255541 A1 12/2004 Thiers et al.
2005/0034404 A1 2/2005 Pervan
2005/0034405 A1 2/2005 Pervan
2005/0102937 A1 5/2005 Pervan
2005/0108970 A1 5/2005 Liu
2005/0138881 A1 6/2005 Pervan
2005/0160694 A1 7/2005 Pervan
2005/0161468 A1 7/2005 Wagner
2005/0166502 A1 8/2005 Pervan
2005/0166514 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0235593 A1 10/2005 Hecht
2006/0048474 A1 3/2006 Pervan
2006/0070333 A1 4/2006 Pervan
2006/0073320 A1 4/2006 Pervan
2006/0075713 A1 4/2006 Pervan et al.
2006/0101769 A1 5/2006 Pervan et al.
2006/0117696 A1 6/2006 Pervan
2006/0179773 A1 8/2006 Pervan
2006/0196139 A1 9/2006 Pervan
2006/0236642 A1 10/2006 Pervan
2006/0260254 A1 11/2006 Pervan
2006/0283127 A1 12/2006 Pervan
2007/0119110 A1 5/2007 Pervan
2007/0159814 A1 7/2007 Jacobsson
2007/0175143 A1 8/2007 Pervan et al.
2007/0175144 A1 8/2007 Hakansson
2007/0175148 A1 8/2007 Bergelin et al.
2007/0175156 A1 8/2007 Pervan et al.
2008/0000182 A1 1/2008 Pervan
2008/0000189 A1 1/2008 Pervan et al.
2008/0005992 A1 1/2008 Pervan
2008/0010931 A1 1/2008 Pervan et al.
2008/0028707 A1 2/2008 Pervan

| | | | |
|---|---|---|---|
| 2008/0060308 | A1 | 3/2008 | Pervan |
| 2008/0104921 | A1 | 5/2008 | Pervan et al. |
| 2008/0120938 | A1 | 5/2008 | Jacobsson et al. |
| 2008/0134607 | A1 | 6/2008 | Pervan et al. |
| 2009/0151291 | A1 | 6/2009 | Pervan |
| 2010/0229491 | A1 | 9/2010 | Pervan |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 991373 | | 6/1976 |
| CA | 2226286 | | 12/1997 |
| CA | 2252791 | | 5/1999 |
| CA | 2289309 | | 7/2000 |
| CA | 2 363 184 | A1 | 7/2001 |
| CH | 200949 | | 1/1939 |
| CH | 211877 | | 1/1941 |
| CH | 690 242 | A5 | 6/2000 |
| DE | 1 212 275 | B | 3/1966 |
| DE | 7102476 | | 1/1971 |
| DE | 1 534 278 | | 11/1971 |
| DE | 2 159 042 | A1 | 6/1973 |
| DE | 22 05 232 | A1 | 8/1973 |
| DE | 7402354 | | 1/1974 |
| DE | 2 238 660 | | 2/1974 |
| DE | 2 252 643 | | 5/1974 |
| DE | 25 02 992 | | 7/1976 |
| DE | 26 16 077 | A1 | 10/1977 |
| DE | 29 17 025 | | 11/1980 |
| DE | 30 41 781 | A1 | 6/1982 |
| DE | 32 14 207 | A1 | 11/1982 |
| DE | 32 46 376 | C2 | 6/1984 |
| DE | 33 43 601 | A1 | 6/1985 |
| DE | 86 04 004 | | 6/1986 |
| DE | 35 12 204 | A1 | 10/1986 |
| DE | 35 38 538 | A1 | 5/1987 |
| DE | 35 44 845 | A1 | 6/1987 |
| DE | 36 31 390 | A1 | 12/1987 |
| DE | 39 18 676 | A1 | 8/1990 |
| DE | 40 02 547 | A1 | 8/1991 |
| DE | 41 30 115 | A1 | 3/1993 |
| DE | 41 34 452 | A1 | 4/1993 |
| DE | 42 15 273 | A1 | 11/1993 |
| DE | 42 42 530 | A1 | 6/1994 |
| DE | 43 13 037 | C1 | 8/1994 |
| DE | 93 17 191 | U1 | 4/1995 |
| DE | 296 10 462 | U1 | 10/1996 |
| DE | 296 18 318 | U1 | 4/1997 |
| DE | 196 01 322 | A1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 198 51 200 | C1 | 3/2000 |
| DE | 299 22 649 | U1 | 4/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | | 12/2000 |
| DE | 200 17 461 | U1 | 3/2001 |
| DE | 200 18 284 | U1 | 3/2001 |
| DE | 100 01 248 | A1 | 7/2001 |
| DE | 100 32 204 | C1 | 7/2001 |
| DE | 202 05 774 | U1 | 9/2002 |
| DE | 203 07 580 | U1 | 7/2003 |
| DE | 203 17 527 | U1 | 2/2004 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |
| EP | 0 652 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 661 135 | B1 | 12/1998 |
| EP | 0 903 451 | A2 | 3/1999 |
| EP | 0 903 451 | A3 | 8/1999 |
| EP | 0 958 441 | | 11/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | A1 | 2/2000 |
| EP | 1 048 423 | A2 | 11/2000 |
| EP | 1 251 219 | A1 | 7/2001 |
| EP | 1 120 515 | A1 | 8/2001 |
| EP | 1 165 906 | A1 | 1/2002 |
| EP | 1 223 265 | | 7/2002 |
| EP | 1 262 609 | A1 | 12/2002 |
| EP | 1 317 983 | A2 | 6/2003 |
| EP | 1 338 344 | A2 | 8/2003 |
| FI | 843060 | | 8/1984 |
| FR | 1.293.043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 9/1968 |
| GB | 1171337 | | 11/1969 |
| GB | 1237 744 | | 6/1971 |
| GB | 1275511 | | 5/1972 |
| GB | 1 394 621 | | 5/1975 |
| GB | 1 430 423 | A | 3/1976 |
| GB | 2 117 813 | A | 10/1983 |
| GB | 2126106 | A | 3/1984 |
| GB | 2 243 381 | A | 10/1991 |
| GB | 2 256 023 | A | 11/1992 |
| GB | 2256023 | A * | 11/1992 |
| JP | 54-65528 | | 5/1979 |
| JP | 57-119056 | | 7/1982 |
| JP | 57-185110 | A | 11/1982 |
| JP | 59-186336 | | 12/1984 |
| JP | 1-178659 | A | 7/1989 |
| JP | 3-169967 | A | 7/1991 |
| JP | 4-106264 | | 4/1992 |
| JP | 4-191001 | | 7/1992 |
| JP | 5-148984 | | 6/1993 |
| JP | 6-146553 | A | 5/1994 |
| JP | 6-56310 | | 8/1994 |
| JP | 6-320510 | A | 11/1994 |
| JP | 7-076923 | A | 3/1995 |
| JP | 7-180333 | A | 7/1995 |
| JP | 7-300979 | A | 11/1995 |
| JP | 7-310426 | A | 11/1995 |
| JP | 8-109734 | A | 4/1996 |
| JP | 9-38906 | A | 2/1997 |
| JP | 9-088315 | A | 3/1997 |
| JP | 2000-179137 | | 6/2000 |
| JP | 2000-226932 | A | 8/2000 |
| NL | 7601773 | | 8/1976 |
| NO | 157871 | | 7/1984 |
| NO | 305614 | | 5/1995 |
| PL | 24931 | U | 11/1974 |
| SE | 372 051 | B | 12/1974 |
| SE | 450 141 | B | 6/1987 |

| | | | |
|---|---|---|---|
| SE | 501 014 | C2 | 10/1994 |
| SE | 502 994 | C2 | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| SU | 1680359 | A1 | 9/1991 |
| WO | WO 84/02155 | A1 | 6/1984 |
| WO | WO 87/03839 | A1 | 7/1987 |
| WO | WO 92/17657 | A1 | 10/1992 |
| WO | WO 93/13280 | A1 | 7/1993 |
| WO | WO 94/01628 | A2 | 1/1994 |
| WO | WO 94/26999 | A1 | 11/1994 |
| WO | WO 96/27719 | A1 | 9/1996 |
| WO | WO 96/27721 | A1 | 9/1996 |
| WO | WO 96/30177 | A1 | 10/1996 |
| WO | WO 97/19232 | A1 | 5/1997 |
| WO | WO 97/47834 | A1 | 12/1997 |
| WO | WO 98/22677 | A1 | 5/1998 |
| WO | WO 98/24994 | A1 | 6/1998 |
| WO | WO 98/24995 | A1 | 6/1998 |
| WO | WO 98/38401 | A1 | 9/1998 |
| WO | WO 99/40273 | A1 | 8/1999 |
| WO | WO 99/66151 | A1 | 12/1999 |
| WO | WO 99/66152 | A1 | 12/1999 |
| WO | WO 00/06854 | A1 | 2/2000 |
| WO | WO 00/20705 | A1 | 4/2000 |
| WO | WO 00/20706 | A1 | 4/2000 |
| WO | WO 00/47841 | A1 | 8/2000 |
| WO | WO 00/66856 | A1 | 11/2000 |
| WO | WO 01/02669 | A1 | 1/2001 |
| WO | WO 01/07729 | A1 | 2/2001 |
| WO | WO 01/51732 | A1 | 7/2001 |
| WO | WO 01/51733 | A1 | 7/2001 |
| WO | WO 01/66876 | A1 | 9/2001 |
| WO | WO 01/66877 | A1 | 9/2001 |
| WO | WO 01/98604 | A1 | 12/2001 |
| WO | WO 02/055809 | A1 | 7/2002 |
| WO | WO 02/055810 | A1 | 7/2002 |
| WO | WO 03/070384 | A1 | 8/2003 |
| WO | WO 03/078761 | A1 | 9/2003 |
| WO | WO 03/099461 | A1 | 12/2003 |
| WO | WO 2005/077625 | A1 | 8/2005 |
| WO | WO 2005/110677 | A1 | 11/2005 |
| WO | WO 2006/008578 | A1 | 1/2006 |
| WO | WO 2006/111437 | A1 | 10/2006 |
| WO | WO 2006/113757 | A1 | 10/2006 |

OTHER PUBLICATIONS

Pervan, Darko, U.S. Appl. No. 11/806,478, entitled "Wear Resistant Surface", filed May 31, 2007.
Webster's Dictionary, Random House: New York (1987), p. 862.
Knight's American Mechanical Dictionary, Hurd and Houghton: New York (1876), p. 2051.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1-2.
Opposition I: Unilin Decor N.V./Välinge Aluminum AB, communication dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
European prosecution file history to grant, European Patent No. 94915725.9-2303/0698162, grant date Sep. 16, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Communication of Notices of Intervention by E.F.P. Floor Products dated Mar. 17, 2000, in European Patent Application 0698162, pp. 1-11 with annex pp. 1-21.
Response to the E.F.P. Floor Products intervention dated Jun. 28, 2000, pp. 1-5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001, in Swedish Patent No. 9801986-2, pp. 1-3 in Swedish with forwarding letter dated Sep. 24, 2001, in English.
*Pergo, Inc.* v. *Välinge Aluminium AB, Berry Finance NV, and Alloc, Inc.*; U.S. District Court for the District of Columbia; Civil Action No. 1:00CV01618.
*Alloc, Inc.* v. *Unilin Decor NV and BHK of America, Inc.*; U.S. District Court for the Eastern District of Wisconsin; Civil Action No. 00-C-0999.
*Unilin Beheer B.V., Unilin Decor, N.V., and BHK of America, Inc.* v. *Välinge Aluminium AB*; U.S. District Court for the District of Columbia; Civil Action No. 1:00CV01823.
*Alloc, Inc., Berry Finance NV, and Välinge Aluminium AB* v. *Unilin Decor NV, BHK of America, Inc., Pergo, Inc., Meister-Leisten Schulte GmbH, Akzenta Paneele+Profile GmbH, Tarkett, Inc., and Roysol*; ITC No. 337-TA-443 Filed Dec. 4, 2000.
*Alloc, Inc., Berry Finance NV, and Välinge Aluminium AB* v. *Tarkett, Inc.*; U.S. District Court for the Eastern District of Wisconsin; Civil Action No. 00-CV-1377.
Välinge, Fibo-Trespo Brochure, Distributed at the Domotex Fair in Hanover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institutet for Trateknisk Forskning, Stockholm, Sweden.
Drawing Figure 25/6107 from Buetec GmbH dated Dec. 16, 1985.
Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.
Pamphlet from Serexhe for Compact-Praxis, entitled "Selbst Teppichböden, PVC and Parkett verlegen", Published by Compact Verlag, München, Germany 1985, pp. 84-87.
Pamphlet from Junckers Industrser A/S entitled "Bøjlesystemet til Junckers boliggulve" Oct. 1994, Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.

* cited by examiner

PRIOR ART TECHNIQUE

PRIOR ART TECHNIQUE

PRIOR ART TECHNIQUE

PRIOR ART TECHNIQUE

PRIOR ART TECHNIQUE

LOCKING SYSTEM FOR MECHANICAL JOINING OF FLOORBOARDS AND METHOD FOR PRODUCTION THEREOF

CROSS-REFERENCES TO RELATED APPLICATIONS

This application is a continuation of U.S. application Ser. No. 10/925,924, filed on Aug. 26, 2004, which is a continuation of U.S. application Ser. No. 10/256,167, filed on Sep. 27, 2002 (now U.S. Pat. No. 6,898,913), which is a continuation of U.S. application Ser. No. 09/954,066, filed on Sep. 18, 2001 (now U.S. Pat. No. 6,510,665), which is a continuation of International Application No. PCT/SE01/00125, filed on Jan. 24, 2001, which International Application was published by the International Bureau in English on Jul. 26, 2001. International Application No. PCT/SE01/00125 claim priority to Swedish Application No. 0000200-6, filed in Sweden on 01-24-2000. The entire contents of International Application No. PCT/SE01/00125 are hereby incorporated herein by reference.

TECHNICAL FIELD

The invention generally relates to the field of mechanical locking of floorboards. The invention relates to an improved locking system for mechanical locking of floorboards, a floorboard provided with such an improved locking system, a flooring made of such mechanically joined floorboards, and a method for making such floorboards. The invention generally relates to an improvement of a locking system of the type described and shown in WO 94/26999 and WO 99/66151.

More specifically, the invention relates to a locking system for mechanical joining of floorboards of the type having a body and preferably a surface layer on the upper side of the body and a balancing layer on the rear side of the body, said locking system comprising: (i) for horizontal joining of a first and a second joint edge portion of a first and a second floorboard respectively at a vertical joint plane, on the one hand a locking groove which is formed in the underside of said second board and extends parallel with and at a distance from said vertical joint plane at said second joint edge and, on the other hand, a strip integrally formed with the body of said first board, which strip at said first joint edge projects from said vertical joint plane and supports a locking element, which projects towards a plane containing the upper side of said first floorboard and which has a locking surface for coaction with said locking groove, and (ii) for vertical joining of the first and second joint edge, on the one hand a tongue which at least partly projects and extends from the joint plane and, on the other hand, a tongue groove adapted to coact with said tongue, the first and second floorboards within their joint edge portions for the vertical joining having coacting upper and coacting lower contact surfaces, of which at least the upper comprise surface portions in said tongue groove and said tongue.

FIELD OF APPLICATION OF THE INVENTION

The present invention is particularly suitable for mechanical joining of thin floating floorboards made up of an upper surface layer, an intermediate fibreboard body and a lower balancing layer, such as laminate flooring and veneer flooring with a fibreboard body. Therefore, the following description of the state of the art, problems associated with known systems, and the objects and features of the invention will, as a non-restricting example, focus on this field of application and, in particular, on rectangular floorboards with dimensions of about 1.2 m*0.2 m and a thickness of about 7-10 mm, intended to be mechanically joined at the long side as well as the short side.

BACKGROUND OF THE INVENTION

Thin laminate flooring and wood veneer flooring are usually composed of a body consisting of a 6-9 mm fibreboard, a 0.20-0.8 mm thick upper surface layer and a 0.1-0.6 mm thick lower balancing layer. The surface layer provides appearance and durability to the floorboards. The body provides stability and the balancing layer keeps the board level when the relative humidity (RH) varies during the year. The RH can vary between 15% and 90%. Conventional floorboards of the type are usually joined by means of glued tongue-and-groove joints (i.e. joints involving a tongue on a floorboard and a tongue groove on an adjoining floorboard) at the long and short sides. When laying the floor, the boards are brought together horizontally, whereby a projecting tongue along the joint edge of a first board is introduced into a tongue groove along the joint edge of the second adjoining board. The same method is used at the long side as well as the short side. The tongue and the tongue groove are designed for such horizontal joining only and with special regard to how glue pockets and gluing surfaces should be designed to enable the tongue to be efficiently glued within the tongue groove. The tongue-and-groove joint presents coacting upper and lower contact surfaces that position the boards vertically in order to ensure a level surface of the finished floor.

In addition to such conventional floors, which are connected by means of glued tongue-and-groove joints, floorboards have recently been developed which are instead mechanically joined and which do not require the use of glue. This type of mechanical joint system is hereinafter referred to as a "strip-lock system", since the most characteristic component of this system is a projecting strip which supports a locking element.

WO 94/26999 and WO88/66151 (owner Välinge Aluminium AB) disclose a strip-lock system for joining building panels, particularly floorboards. This locking system allows the boards to be locked mechanically at right angles to as well as parallel with the principal plane of the boards at the long side as well as at the short side. Methods for making such floorboards are disclosed in EP 0958441 and EP 0958442 (owner Välinge Aluminium AB). The basic principles of the design and the installation of the floorboards, as well as the methods for making the same, as described in the four above-mentioned documents are usable for the present invention as well, and therefore these documents are hereby incorporated by reference.

In order to facilitate the understanding and description of the present invention, as well as the comprehension of the problems underlying the invention, a brief description of the basic design and function of the known floorboards according to the above-mentioned WO 94/26999 and WO 99/66151 will be given below with reference to FIGS. 1-3 in the accompanying drawings. Where applicable, the following description of the prior art also applies to the embodiments of the present invention described below.

FIGS. 3*a* and 3*b* are thus a top view and a bottom view respectively of a known floorboard 1. The board 1 is rectangular with a top side 2, an underside 3, two opposite long sides 4*a*, 4*b* forming joint edge portions and two opposite short sides 5*a*, 5*b* forming joint edge portions.

Without the use of the glue, both the long sides 4*a*, 4*b* and the short sides 5*a*, 5*b* can be joined mechanically in a direction D2 in FIG. 1*c*, so that they join in a joint plane F (marked in FIG. 2*c*). For this purpose, the board 1 has a flat strip 6, mounted at the factory, projecting horizontally from its one long side 4*a*, which strip extends throughout the length of the long side 4*a* and which is made of flexible, resilient sheet aluminium. The strip 6 can be fixed mechanically according to the embodiment shown, or by means of glue, or in some other way. Other strip materials can be used, such as sheets of other metals, as well as aluminium or plastic sections. Alternatively, the strip 6 may be made in one piece with the board 1, for example by suitable working of the body of the board 1. The present invention is usable for floorboards in which the strip is integrally formed with the body and solves special problems appearing in such floorboards and the making thereof. The body of the floorboard need not be, but is preferably, made of a uniform material. However, the strip 6 is always integrated with the board 1, i.e. it is never mounted on the board 1 in connection with the laying of the floor but it is mounted or formed at the factory. The width of the strip 6 can be about 30 mm and its thickness about 0.5 mm. A similar, but shorter strip 6' is provided along one short side 5*a* of the board 1. The part of the strip 6 projecting from the joint plane F is formed with a locking element 8 extended throughout the length of the strip 6. The locking element 8 has an operative locking surface 10 facing the joint plane F and having a height of e.g. 0.5 mm. When the floor is being laid, this locking surface 10 coacts with a locking groove 14 formed in the underside 3 of the joint edge portion 4*b* of the opposite long side of an adjoining board 1'. The short side strip 6' is provided with a corresponding locking element 8', and the joint edge portion 5*b* of the opposite short side has a corresponding locking groove 14'. The edge of the locking grooves 14, 14' facing away from the joint plane F forms an operative locking surface 10' for coaction with the operative locking surface 10 of the locking element.

Moreover, for mechanical joining of both long sides and short sides also in the vertical direction (direction D1 in FIG. 1*c*) the board is formed with a laterally open recess 16 along one long side (joint edge portion 4*a*) and one short side (joint edge portion 5*a*). At the bottom, the recess 16 is defined by the respective strips 6, 6'. At the opposite edge portions 4*b* and 5*b* there is an upper recess 18 defining a locking tongue 20 coacting with the recess 16 (see FIG. 2*a*).

FIGS. 1*a*-1*c* show how two long sides 4*a*, 4*b* of two such boards 1, 1' on an underlay 12 can be joined together by means of downward angling. FIGS. 2*a*-2*c* show how the short sides 5*a*, 5*b* of the boards 1, 1' can be joined together by snap action. The long sides 4*a*, 4*b* can be joined together by means of both methods, while the short sides 5*a*, 5*b*—when the first row has been laid—are normally joined together subsequent to joining together the long sides 4*a*, 4*b* and by means of snap action only.

When a new board 1' and a previously installed board 1 are to be joined together along their long sides 4*a*, 4*b* as shown in FIGS. 1*a*-1*c*, the long side 4*b* of the new board 1' is pressed against the long side 4*a* of the previous board 1 as shown in FIG. 1*a*, so that the locking tongue 20 is introduced into the recess 16. The board 1' is then angled downwards towards the subfloor 12 according to FIG. 1*b*. In this connection, the locking tongue 20 enters the recess 16 completely, while the locking element 8 of the strip 6 enters the locking groove 14. During this downward angling the upper part 9 of the locking element 8 can be operative and provide guiding of the new board 1' towards the previously installed board 1. In the joined position as shown in FIG. 1*c*, the boards 1, 1' are locked in both the direction D1 and the direction D2 along their long sides 4*a*, 4*b*, but the boards 1, 1' can be mutually displaced in the longitudinal direction of the joint along the long sides 4*a*, 4*b*.

FIGS. 2*a*-2*c* show how the short sides 5*a* and 5*b* of the boards 1, 1' can be mechanically joined in the direction D1 as well as the direction D2 by moving the new board 1' towards the previously installed board 1 essentially horizontally. Specifically, this can be carried out subsequent to joining the long side of the new board 1' to a previously installed board 1 in an adjoining row by means of the method according to FIGS. 1*a*-1*c*. In the first step in FIG. 2*a*, beveled surfaces adjacent to the recess 16 and the locking tongue 20 respectively cooperate such that the strip 6' is forced to move downwards as a direct result of the bringing together of the short sides 5*a*, 5*b*. During the final bringing together of the short sides, the strip 6' snaps up when the locking element 8' enters the locking groove 14', so that the operative locking surfaces 10, 10' of the locking element 8' and of the locking groove 14' will engage each other.

By repeating the steps shown in FIGS. 1*a*-*c* and 2*a*-*c*, the whole floor can be laid without the use of glue and along all joint edges. Known floorboards of the above-mentioned type are thus mechanically joined usually by first angling them downwards on the long side, and when the long side has been secured, snapping the short sides together by means of horizontal displacement of the new board 1' along the long side of the previously installed board 1. The boards 1, 1' can be taken up in the reverse order of laying without causing any damage to the joint, and be laid again. These laying principles are also applicable to the present invention.

For optimal function, subsequent to being joined together, the boards should be capable of assuming a position along their long sides in which a small play can exist between the operative locking surface 10 of the locking element and the operative locking surface 10' of the locking groove 14. Reference is made to WO 94/26999 for a more detailed description of this play.

In addition to what is known from the above-mentioned patent specifications, a licensee of Välinge Aluminium AB, Norske Skog Flooring AS, Norway (NSF), introduced a laminated floor with mechanical joining according to WO 94/26999 in January 1996 in connection with the Domotex trade fair in Hannover, Germany. This laminated floor, which is marketed under the trademark Alloc®, is 7.2 mm thick and has a 0.6-mm aluminium strip 6 which is mechanically attached on the tongue side. The operative locking surface 10 of the locking element 8 has an inclination (hereinafter termed locking angle) of about 80.degree.0 to the plane of the board. The vertical connection is designed as a modified tongue-and-groove joint, the term "modified" referring to the possibility of bringing the tongue groove and tongue together by way of angling.

WO 97/47834 (owner Unilin Beeher B. V., the Netherlands) describes a strip-lock system which has a fibreboard strip and is essentially based on the above known principles. In the corresponding product, "Uniclic®", which this owner began marketing in the latter part of 1997, one seeks to achieve biasing of the boards. This results in high friction and makes it difficult to angle the boards together and to displace them. The document shows several embodiments of the locking system. The "Uniclic®" product is shown in section in FIG. 4*b*.

Other known locking systems for mechanical joining of board materials are described in, for example, GB-A-2,256,023 showing unilateral mechanical joining for providing an expansion joint in a wood panel for outdoor use, and in U.S. Pat. No. 4,426,820 (shown in FIG. 4*d*) which concerns a mechanical locking system for plastic sports floors, which floor is intentionally designed in such manner that neither displacement of the floorboards along each other nor locking of the short sides of the floorboards by snap action is allowed.

In the autumn of 1998, NSF introduced a 7.2-mm laminated floor with a strip-lock system which comprises a fibreboard strip and is manufactured according to WO 94/26999 and WO 99/66151. This laminated floor is marketed under the trademark "Fiboloc®" and has the cross-section illustrated in FIG. 4*a*.

In January 1999, Kronotex GmbH, Germany, introduced a 7.8 mm thick laminated floor with a strip lock under the trademark "Isilock®". A cross-section of the joint edge portion of this system is shown in FIG. 4*c*. Also in this floor, the strip is composed of fibreboard and a balancing layer.

During 1999, the mechanical joint system has obtained a strong position on the world market, and some twenty manufacturers have shown, in January 2000, different types of systems which essentially are variants of Fiboloc®, Uniclic® and Isilock®.

SUMMARY OF THE INVENTION

Although the floor according to WO 94/26999 and WO 99/66151 and the floor sold under the trademark Fiboloc® exhibit major advantages in comparison with traditional, glued floors, further improvements are desirable mainly in thin floor structures.

The joint system consists of three parts. An upper part P1 which takes up the load on the floor surface in the joint. An intermediate part P2 that is necessary for forming the vertical joint in the D1 direction in the form of tongue and tongue groove. A lower part P3 which is necessary for forming the horizontal lock in the D2 direction with strip and locking element.

In thin floorboards, it is difficult to provide, with prior-art technique, a joint system which at the same time has a sufficiently high and stable upper part, a thick, strong and rigid tongue and a sufficiently thick strip with a high locking element. Nor does a joint system according to FIG. 4*d*, i.e. according to U.S. Pat. No. 4,426,820, solve the problem since a tongue groove with upper and lower contact surfaces which are parallel with the upper side of the floorboard or the floor plane, cannot be manufactured using the milling tools which are normally used when making floorboards. The rest of the joint geometry in the design according to FIG. 4*d* cannot be manufactured by working a wood-based board since all surfaces abut each other closely, which does not provide space for manufacturing tolerances. Moreover, strip and locking elements are dimensioned in a manner that requires considerable modifications of the joint edge portion that is to be formed with a locking groove.

At present there are no known products or methods which afford satisfactory solutions to problems that are related to thin floorboards with mechanical joint systems. It has been necessary to choose compromises which (i) either result in a thin tongue and sufficient material thickness in the joint edge portion above the corresponding tongue groove in spite of plane-parallel contact surfaces or (ii) use upper and lower contact surfaces angled to each other and downwardly extending projections and corresponding recesses in the tongue and the tongue groove respectively of adjoining floorboards or (iii) result in a thin and mechanically weak locking strip with a locking element of a small height.

Therefore an object of the present invention is to obviate this and other drawbacks of prior art. Another object of the invention is to provide a locking system, a floorboard, and a method for making a floorboard having such a locking system, in which it is at the same time possible to obtain (i) a stable joint with tongue and tongue groove, (ii) a stable portion of material above the tongue groove, (iii) a strip and a locking element, which have high strength and good function.

To achieve these criteria simultaneously, it is necessary to take the conditions into consideration which are present in the manufacture of floorboards with mechanical locking systems. The problems arise mainly when laminate-type thin floorboards are involved, but the problems exist in all types of thin floorboards. The three contradictory criteria will be discussed separately in the following.

(i) Tongue-and-Groove Joint

If the floor is thin there is not sufficient material for making a tongue groove and a tongue of sufficient thickness for the intended properties to be obtained. The thin tongue will be sensitive to laying damage, and the strength of the floor in the vertical direction will be insufficient. If one tries to improve the properties by making the contact surfaces between tongue and tongue groove oblique instead of parallel with the upper side of the floorboard, the working tools must during working be kept extremely accurately positioned both vertically and horizontally relative to the floorboard that is being made. This means that the manufacture will be significantly more difficult, and that it will be difficult to obtain optimal and accurate fitting between tongue and tongue groove. The tolerances in manufacture must be such that a fitting of a few hundredths of a millimeter is obtained since otherwise it will be difficult or impossible to displace the floorboards parallel with the joint edge in connection with the laying of the floorboards.

(ii) Material Portion Above the Tongue Groove

In a mechanical locking system glue is not used to keep tongue and tongue groove together in the laid floor. At a low relative humidity the surface layer of the floorboards shrinks, and the material portion that is located above the tongue groove and consequently has no balancing layer on its underside, can in consequence be bent upwards if this material portion is thin. Upwards bending of this material portion may result in a vertical displacement between the surface layers of adjoining floorboards in the area of the joint and causes an increased risk of wear and damage to the joint edge. To reduce the risk of upwards bending, it is therefore necessary to strive to obtain as thick a material portion as possible above the tongue groove. With known geometric designs of locking systems for mechanical joining of floorboards, it is then necessary to reduce the thickness of the tongue and tongue groove in the vertical direction of the floorboard if at the same time efficient manufacture with high and exact tolerances is to be carried out. A reduced thickness of tongue and tongue groove, however, results in, inter alia, the drawbacks that the strength of the joint perpendicular to the plane of the laid floor is reduced and that the risk of damage caused during laying increases.

(iii) Strip and Locking Element

The strip and the locking element are formed in the lower portion of the floorboard. If the total thickness of a thin floorboard is to be retained and at the same time a thick material portion above the locking groove is desirable, and locking element and strip are to be formed merely in that part of the floorboard which is positioned below the tongue groove, the possibilities of providing a strip having a locking element with a sufficiently high locking surface and upper guiding part will be restricted in an undesirable manner. The strip closest to the joint plane and the lower part of the tongue groove can be too thick and rigid and this makes the locking by snap action by backwards bending of the strip difficult. If at the same time the material thickness of the strip is reduced and a large part of the lower contact surface is retained in the tongue groove, this results on the other hand in a risk that the floorboard will be damaged while being laid or subsequently removed.

A problem that is also to be taken into consideration in the manufacture of floorboards, in which the components of the locking system—tongue/tongue groove and strip with a locking element engaging a locking groove—are to be made by working the edge portions of a board-shaped starting material, is that it must be possible to guide the tools in an easy way and position them correctly and with an extremely high degree of accuracy in relation to the board-shaped starting material. Guiding of a chip-removing tool in more than one direction means restrictions in the manufacture and also causes a great risk of reduced manufacturing tolerances and, thus, a poorer function of the finished floorboards.

To sum up, there is a great need for providing a locking system which takes the above-mentioned requirements, problems and desiderata into consideration to a greater extent than prior art. The invention aims at satisfying this need.

These and other objects of the invention are achieved by a locking system, a floorboard, a floor and a manufacturing method having the features stated in the independent claims. The dependent claims define particularly preferred embodiments of the invention.

The invention is based on a first understanding that the identified problems must essentially be solved with a locking system where the lower contact surface of the tongue groove is displaced downwards and past the upper part of the locking element.

The invention is also based on a second understanding which is related to the manufacturing technique, viz. that the tongue groove must be designed in such manner that it can be manufactured rationally and with extremely high precision using large milling tools which are normally used in floor manufacture and which, during their displacement relative to the joint edge portions of the floorboard that is to be made, need be guided in one direction only to provide the parallel contact surfaces while the tool is displaced along the joint edge portion of the floorboard material (or alternatively the joint edge portion is displaced relative to the tool). In known designs of the joint edge portions, such working requires in most cases guiding in two directions while at the same time a relative displacement of tool and floorboard material takes place.

According to a first aspect of the invention, a locking system is provided of the type which is stated by way of introduction and which according to the invention is characterised by the combination that the upper and lower contact surfaces are essentially plane-parallel and extend essentially parallel with a plane containing the upper side of the floorboards, and that the upper edge of the locking element, which upper edge is closest to a plane containing the upper side of the floorboards, is located in a horizontal plane, which is positioned between the upper and the lower contact surfaces but closer to the lower than the upper contact surfaces.

According to another aspect of the invention, a new manufacturing method for making strip and tongue groove is provided. According to conventional methods, the tongue groove is always made by means of a single tool. The tongue groove according to the invention is made by means of two tools in two steps where the lower part of the tongue groove and its lower contact surface are made by means of one tool and the upper part of the tongue groove and its upper contact surface are made by means of another tool. The method according to the invention comprises the steps 1) of forming part of the strip, part of the lower part of the tongue groove and the lower contact surface by means of an angled milling tool operating at an angle <90.degree. to the horizontal plane of the floorboard and the strip, and 2) forming the upper part of the tongue groove and the upper contact surface by means of a separate horizontally operating tool.

According to another aspect of the invention, also a method for making a locking system and floorboards of the above type with plane-parallel upper and lower contact surfaces is provided. This method is characterised in that parts of said tongue groove and at least parts of the lower contact surface are formed by means of a chip-removing tool, whose chip-removing surface portions are brought into removing contact with the first joint portion and are directed obliquely inwards and past said joint plane and that the upper contact surface and parts of the tongue groove are formed by means of a chip-removing tool, whose chip-removing surface portions are moved into removing contact with the first joint portion in a plane which is essentially parallel with a plane containing the upper side of the floorboard.

DESCRIPTION OF PREFERRED EMBODIMENTS

Prior to the description of preferred embodiments, with reference to FIG. 5, a detailed explanation will first be given of the most important parts in a strip lock system.

Figure 5:
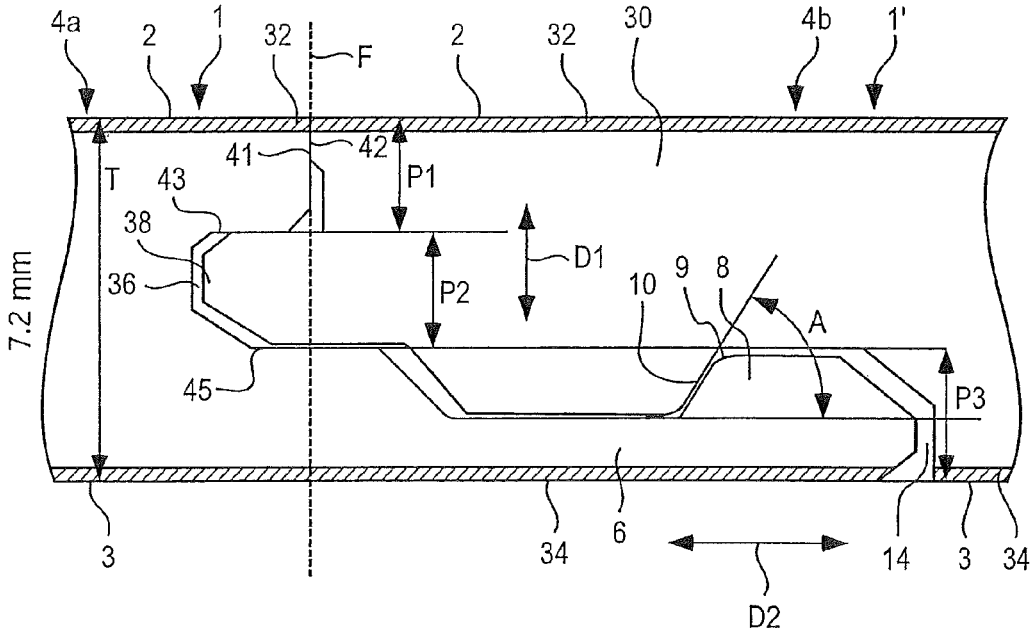
FIG. 5 shows a strip lock for joining of long sides of floorboards, where the different parts of the joint system are made in three levels P1, P2 and P3 as shown and described in WO 99/66151.

The cross-sections shown in FIG. 5 are hypothetical, not published cross-sections, but they are fairly similar to the locking system of the known floorboard "Fiboloc®" and to the locking system according to WO 99/66151. Accordingly, FIG. 5 does not represent the invention. Parts corresponding to those in the previous Figures are in most cases provided with the same reference numerals. The construction, function and material composition of the basic components of the boards in FIG. 5 are essentially the same as in embodiments of the present invention, and consequently, where applicable, the following description of FIG. 5 also applies to the subsequently described embodiments of the invention.

In the embodiment shown, the boards 1, 1' in FIG. 5 are rectangular with opposite long sides 4*a*, 4*b* and opposite short sides 5*a*, 5*b*. FIG. 5 shows a vertical cross-section of a part of a long side 4*a* of the board 1, as well as a part of a long side 4*b* of an adjoining board 1'. The bodies of the boards 1 can be composed of a fibreboard body 30, which supports a surface layer 32 on its front side and a balancing layer 34 on its rear side (underside). A strip 6 is formed from the body and balancing layer of the floorboard and supports a locking element 8. Therefore the strip 6 and the locking element 8 in a way constitute an extension of the lower part of the tongue groove 36 of the floorboard 1. The locking element 8 formed on the strip 6 has an operative locking surface 10 which cooperates with an operative locking surface 10' in a locking groove 14 in the opposite joint edge 4*b* of the adjoining board 1'. By the engagement between the operative locking surfaces 10, 10' a horizontal locking of the boards 1, 1' transversely of the joint edge (direction D2) is obtained. The operative locking surface 10 of the locking element 8 and the operative locking surface 10' of the locking groove form a locking angle A with a plane parallel with the upper side of the floorboards. This locking angle is <90.degree.0, preferably 55-85.degree. The upper part of the locking element has a guiding part 9 which, when angled inwards, guides the floorboard to the correct position. The locking element and the strip have a relative height P3.

To form a vertical lock in the D1 direction, the joint edge portion 4*a* has a laterally open tongue groove 36 and the opposite joint edge portion 4*b* has a laterally projecting tongue 38 which in the joined position is received in the tongue groove 36. The upper contact surfaces 43 and the lower contact surfaces 45 of the locking system are also plane and parallel with the plane of the floorboard.

In the joined position according to FIG. 5, the two juxtaposed upper joint edge portions 41 and 42 of the boards 1, 1' define a vertical joint plane F. The tongue groove has a relative height P2 and the material portion above the upper contact surface 43 of the tongue groove has a relative height P1 up to the upper side 32 of the floorboard. The material portion of the floorboard below the tongue groove has a relative height P3. Also the height of the locking element 8 corresponds to approximately the height P3. The thickness of the floorboard therefore is T=P1+P2+P3.

Figure 1A:
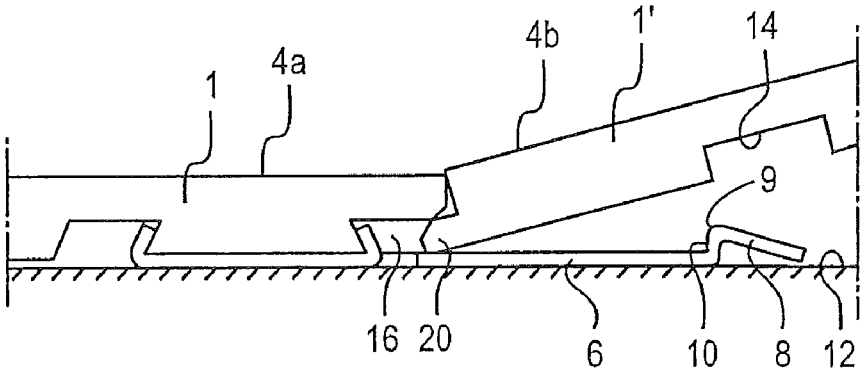
FIGS. 1*a-c* show in three stages a downward angling method for mechanical joining of long sides of floorboards according to WO 94/26999.
Figure 6:
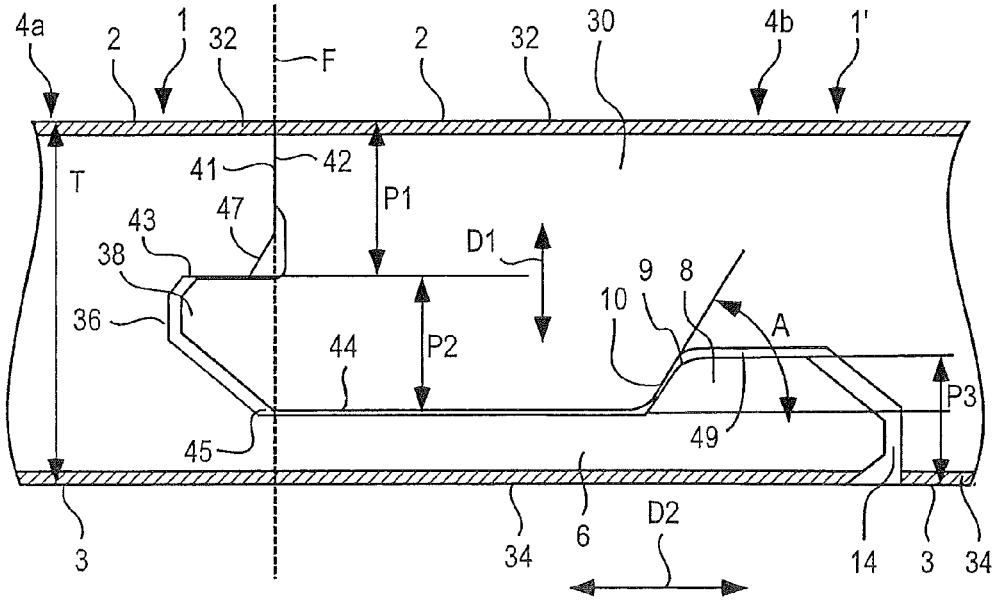
FIG. 6 shows parts of two joined floorboards which have been formed with a locking system according to the present invention.

FIG. 6 shows an example of an embodiment according to the invention, which differs from the embodiment in FIG. 5 by the tongue 38 and the tongue groove 36 being displaced downwards in the floorboard so that they are eccentrically positioned. Moreover, the thickness of the tongue 38 (and, thus, the tongue groove 36) has been increased while at the same time the relative height of the locking element 8 has been retained at approximately P3. Both the tongue 38 and the material portion above the tongue groove 36 are therefore significantly more rigid and stronger while at the same time the floor thickness T, the outer part of the strip 6 and the locking element 8 are unchanged. In the invention, the lower contact surface 45 has been displaced outwards to be positioned essentially outside the tongue groove 36 and outside the joint plane F on the upper side of the strip 6. By the inclination of the underside 44 of the outer part of the tongue, the tongue 38 will thus engage the lower contact surface at, or just outside, the joint plane F. Moreover, the tongue groove 36 extends further into the floorboard 1 than does the free end of the tongue 38 in the mounted state, so that there is a gap 46 between tongue and tongue groove. This gap 46 facilitates the insertion of the tongue 38 into the tongue groove 36 when being angled inwards similarly to that shown in FIG. 1*a*. Moreover, the upper opening edge of the tongue groove 36 at the joint plane F is beveled at 47, which also facilitates the insertion of the tongue into the tongue groove.

Figure 1B:
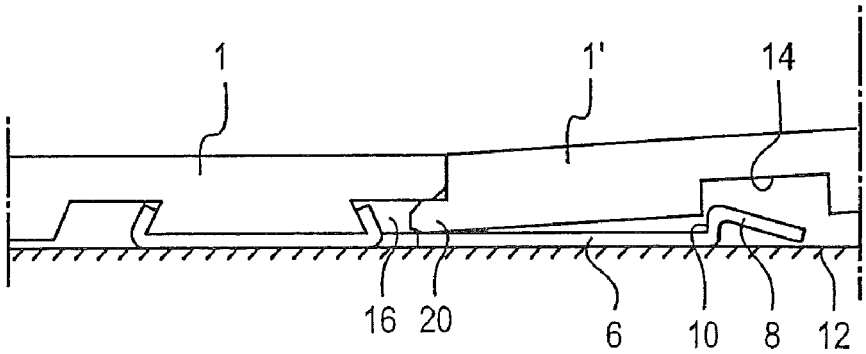
Figure 1C:
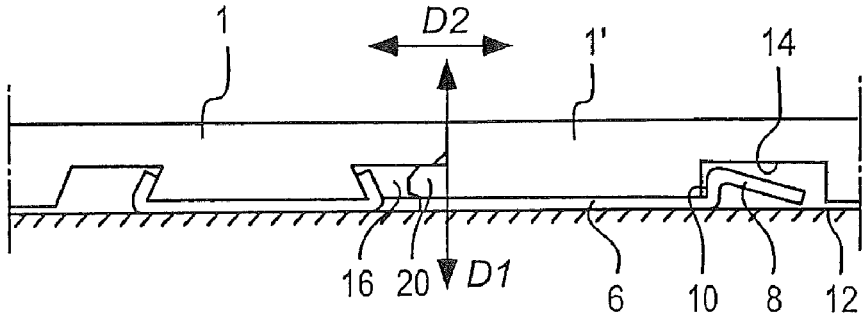
Figure 2A:
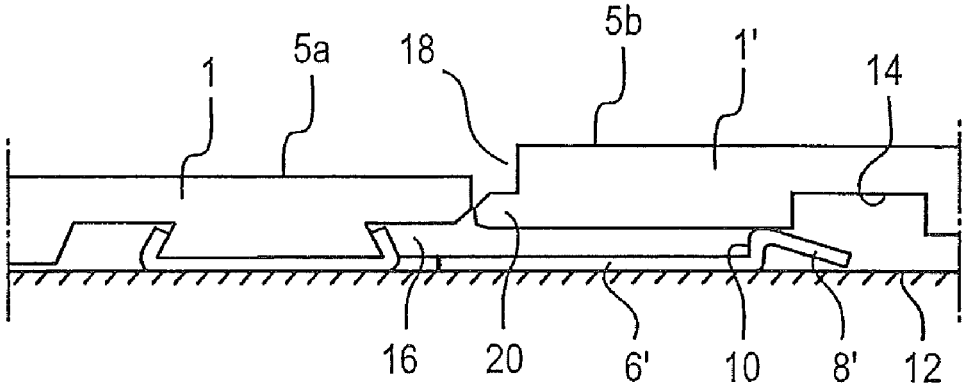
FIGS. 2*a-c* show in three stages a snap-action method for mechanical joining of short sides of floorboards according to WO 94/26999.
Figure 2B:
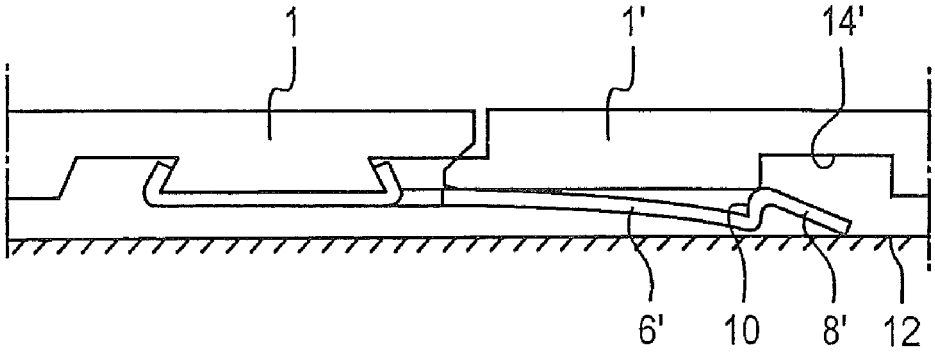
Figure 2C:
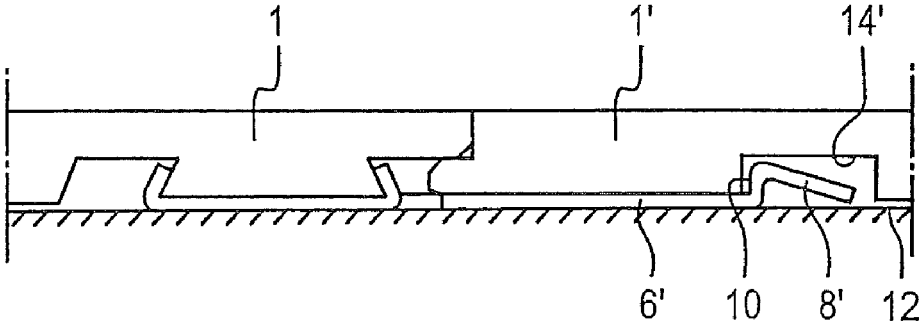
Figure 3A:
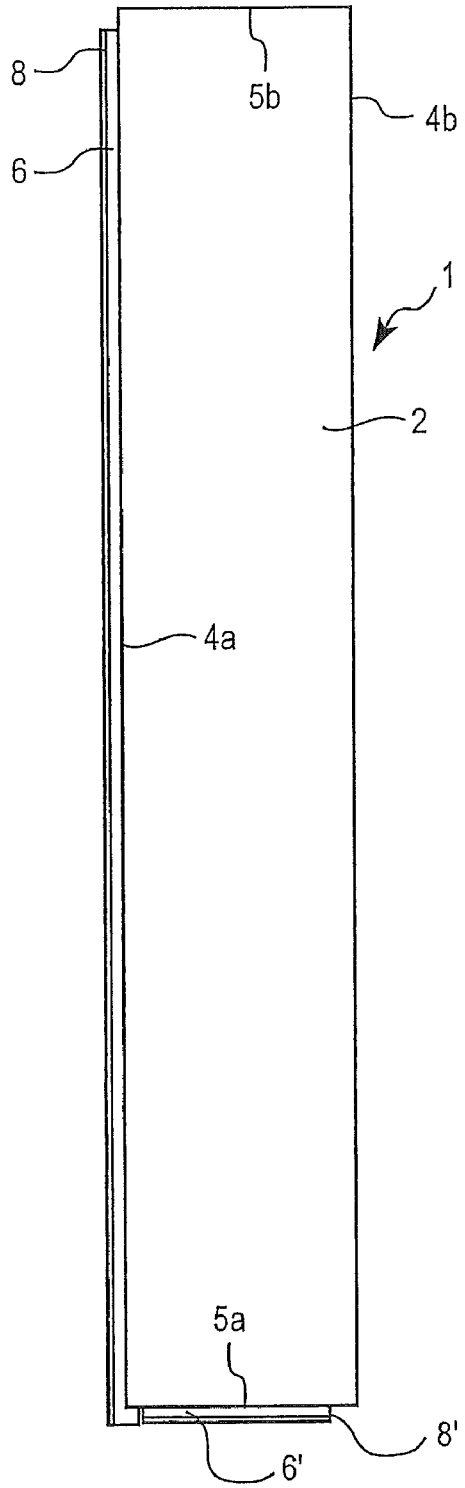
FIGS. 3*a-b* are a top plan view and a bottom view respectively of a floorboard according to WO 94/26999.
Figure 3B:
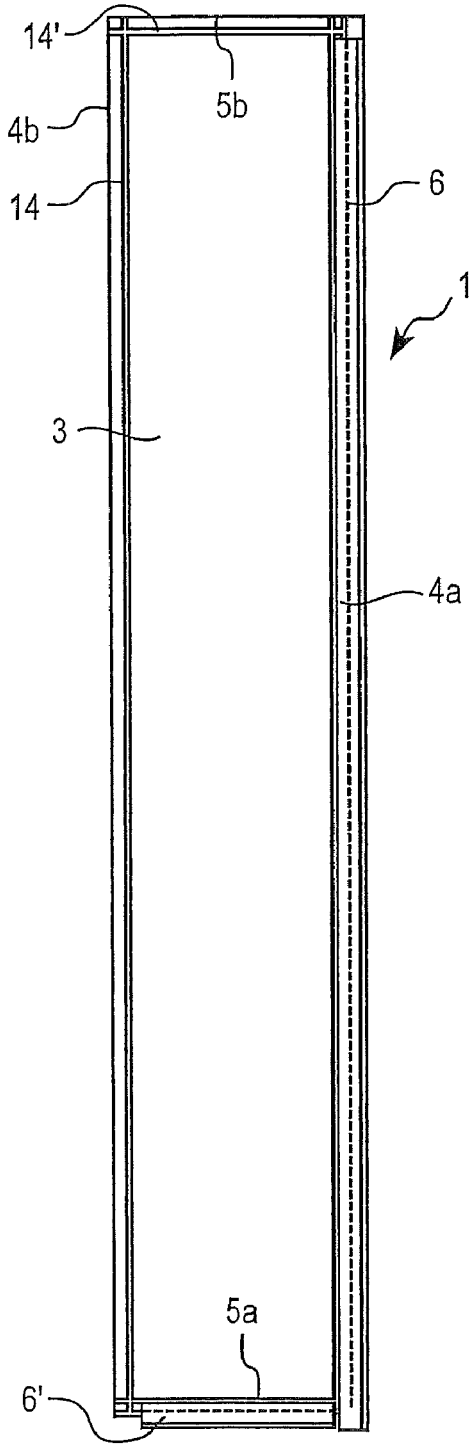
Figure 4A:
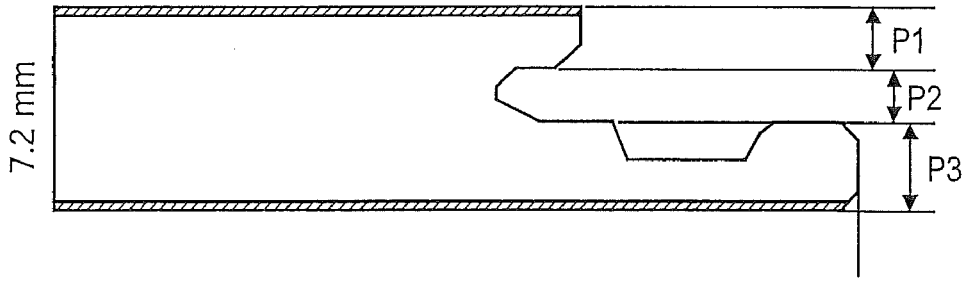
FIG. 4 shows three strip-lock systems available on the market with an integrated strip of fibreboard and a balancing layer, and a strip lock system according to U.S. Pat. No. 4,426,820.
Figure 4B:
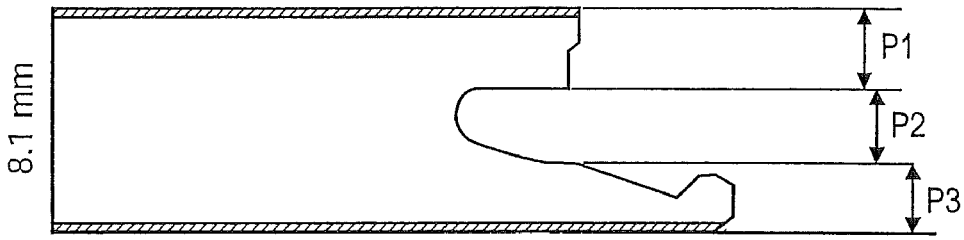
Figure 4C:
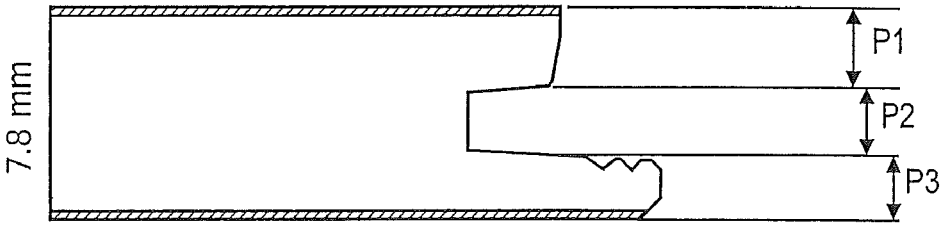
Figure 4D:
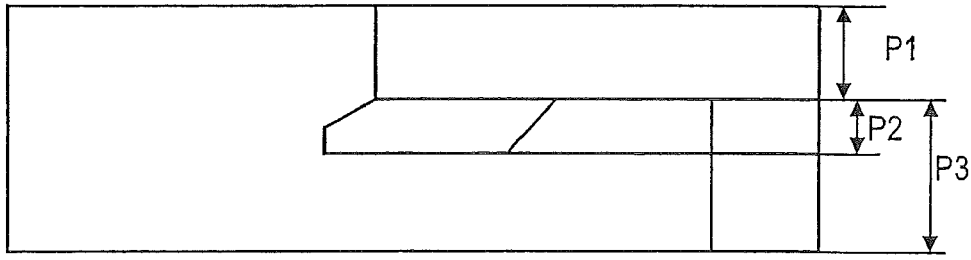

As mentioned, the height of the locking element 8 has been retained essentially unchanged compared with prior art according to WO 99/661151 and "Fiboloc®". This results in the locking effect being retained. The locking angle A of the two cooperating operative locking surfaces 10, 10' is <90.degree. and preferably in the range 55-85.degree. Most preferably, the locking surfaces 10, 10' extend approximately tangentially to a circular arc which has its centre where the joint plane F passes through the upper side of the floorboard. If the guiding portion 9 of the locking element immediately above the locking surface 10 has been slightly rounded, the guiding of the locking element 8 into the locking groove 14 is facilitated in the downward angling of the floorboard 1' similarly to that shown in FIG. 1*b*. Since the locking together of the two adjoining floorboards 1, 1' in the D2 direction is achieved by the engagement between the operative locking surfaces 10, 10', the locking groove 14 can be somewhat wider than the locking element 8, seen transversely of the joint, so that there can be a gap between the outer end of the locking element and the corresponding surface of the locking groove. As a result, the mounting of the floorboards is facilitated without reducing the locking effect. Moreover, it is preferred to have a gap between the upper side of the locking element 8 and the bottom of the locking groove 14. Therefore the depth of the groove 14 should be at least equal to the height of the locking element 8, but preferably the depth of the groove should be somewhat greater than the height of the locking element.

According to a particularly preferred embodiment of the invention, the tongue 38 and the tongue groove 36 are to be positioned eccentrically in the thickness direction of the floorboards and placed closer to the underside than to the upper side of the floorboards.

The most preferred according to the invention is that the locking system and the floorboards satisfy the relationship $$T-(P1+0.3*P2)>P3, \text{ where}$$

T=thickness of the floorboard,

P=distance between the upper side 2 of the floorboard and said upper contact surface 43, measured in the thickness direction of the floorboard, P2=distance between said upper and lower contact surfaces 43, 45, measured in the thickness direction of the floorboard, and P3=distance between the upper edge 49 of the locking element 8 closest to the upper side of the floorboard and the underside 3 of the floorboard.

It has been found advantageous from the viewpoint of strength and function if the locking system also satisfies the relationship P2>P3.

Moreover, it has been found particularly advantageous if the relationship P3>0.3*T is satisfied since this results in more reliable connection of adjoining floorboards.

If the relationship P1>0.3*T is satisfied, the best material thickness is obtained in the material portion between the tongue groove 36 and the upper side 2 of the floorboard. This reduces the risk of this material portion warping so that the superposed surface coating will no longer be in the same plane as the surface coating of an adjoining floorboard.

To ensure great strength of the tongue 38 it is preferred for the dimensions of the tongue to satisfy the relationship P2>0.3*T.

By forming the cooperating portions of the tongue 38 and the tongue groove 36 in such manner that the inner boundary surfaces of the tongue groove in the first floorboard 1 are positioned further away from the vertical joint plane F than the corresponding surfaces of the tongue 38 of the second floorboard 1' when the first and the second floorboards are mechanically assembled, the insertion of the tongue into the tongue groove is facilitated. At the same time the requirements for exact guiding of the chip-removing tools in the plane of the floorboards are reduced.

Moreover it is preferred for the locking groove 14, seen perpendicular to the joint plane F, to extend further away from the vertical joint plane F than do corresponding portions of the locking element 8, when the first and the second floorboards 1, 1' are mechanically assembled. This design also facilitates laying and taking up of the floorboards.

In a floor which is laid using boards with a locking system according to the present invention, the first and the second floorboards are identically designed. Moreover it is preferred for the floorboards to be mechanically joinable with adjoining floorboards along all four sides by means of a locking system according to the present invention.

Figure 7:
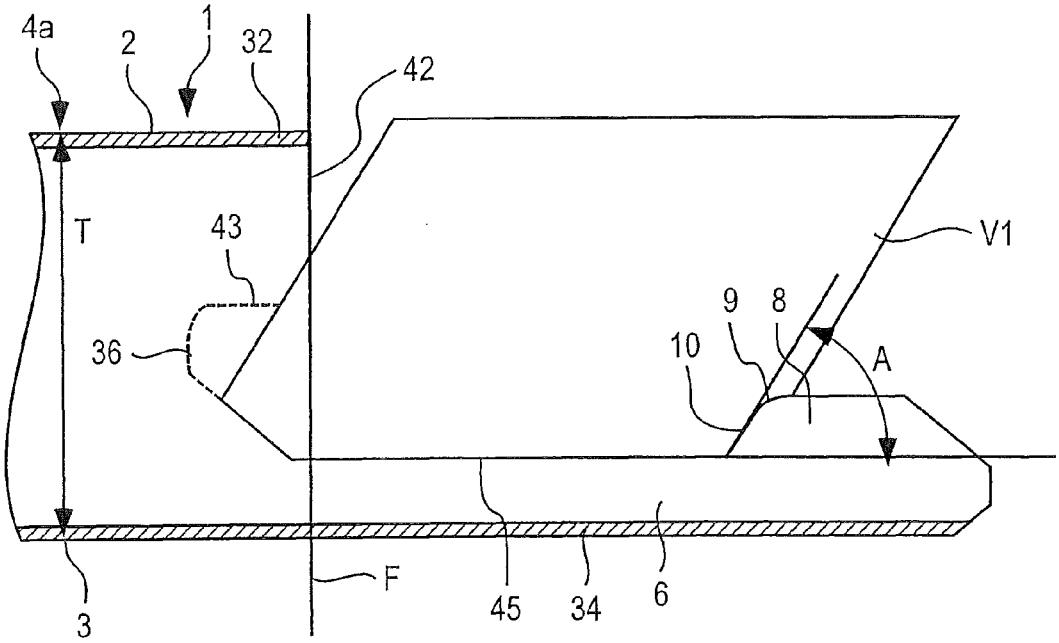
FIGS. 7+8 illustrate an example of a manufacturing method according to the invention for manufacturing a floorboard with a locking system according to the invention.
Figure 8:
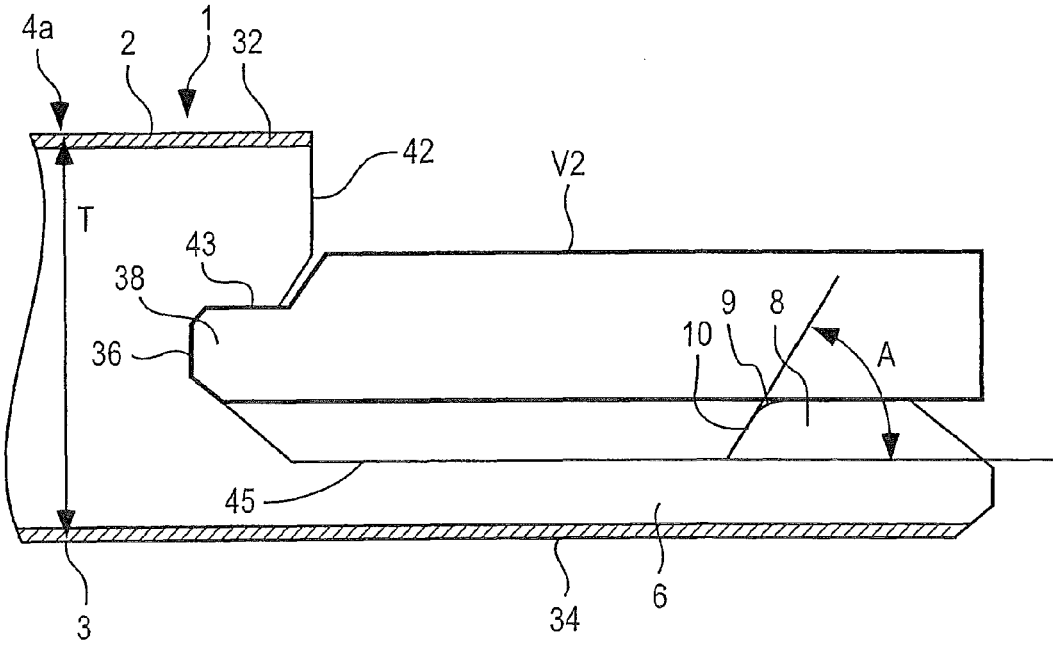

FIGS. 7 and 8 describe the manufacturing technique according to the present invention. Like in prior-art technique, chip-removing working is used, in which chip-removing milling or grinding tools are brought into chip-removing contact with parts of said first and second joint edges 4*a*, 4*b* of the floorboard on the one hand to form the upper surface portions 41, 42 of the joint edges 4*a*, 4*b* so that these are positioned exactly at the correct distance from each other, measured in the width direction of the floorboard, and on the other hand to form the locking groove 14, the strip 6, the locking element 8, the tongue 38, the tongue groove 36 and the upper and lower contact surfaces 43 and 45 respectively.

Like in prior-art technique, the floorboard material is first worked to obtain the correct width and the correct length between the upper surface portions 41, 42 of the joint edges 4*a*, 4*b* (5*a*, 5*b* respectively).

According to the invention, the subsequent chip-removing working then takes place, in contrast to prior-art technique, by chip-removing working in two stages with tools which must be guided with high precision in one direction only (in addition to the displacement direction along the floorboard material).

Manufacturing by means of angled tools is a method known per se, but manufacturing of plane-parallel contact surfaces between tongue and tongue groove in combination with a locking element, whose upper side is positioned in a plane above the lower contact surface of the locking system, is not previously known.

In contrast to prior-art technique the tongue groove 36 is thus made in two distinct stages by using two tools V1, V2. The first chip-removing tool V1 is used to form parts of the tongue groove 38 closest to the underside 3 of the floorboard and at least part of the lower contact surface 45. This tool V1 has chip-removing surface portions which are directed obliquely inwards and past the joint plane F. An embodiment of the chip-removing surface portions of this first tool is shown in FIG. 7. In this case, the tool forms the entire lower contact surface 45, the lower parts of the tongue groove 36 which is to be made, and the operative locking surface portion 10 and guiding surface 9 of the locking element 8. As a result, it will be easier to maintain the necessary tolerances since this tool need be positioned with high precision merely as regards cutting depth (determines the position of the lower contact surface 45 in the thickness direction of the floorboard) and in relation to the intended joint plane F. In this embodiment, this tool therefore forms portions of the tongue groove 36 up to the level of the upper side of the locking element 8. The location of the tool in the vertical direction relative to the floorboard is easy to maintain, and if the location perpendicular to the joint plane F is exactly guided, the operative surface portion 10 of the locking element will be placed exactly at the correct distance from the edge between the joint plane F and the upper side 3 of the floorboard.

The first tool V1 thus forms parts of the tongue groove 36 that is to be made, the strip 6, the lower contact surface 45, the operative locking surface 10 and the guiding part 9 of the locking element 8. Preferably this tool is angled at an angle A to the principal plane of the floorboard, which corresponds to the angle of the locking surface.

It is obvious that this working in the first manufacturing step can take place in several partial steps, where one of the partial steps is the forming of merely the lower parts of the tongue groove and of the lower contact surface 45 outside the joint plane 5 by means of an angled milling tool. The rest of the strip and the locking element can in a subsequent partial step be formed by means of another tool, which can also be angled and inclined correspondingly. The second tool, however, can also be straight and be moved perpendicular downwards in relation to the upper side of the floorboard. Therefore the tool V1 can be divided into two or more partial tools, where the partial tool closest to the joint plane F forms parts of the tongue groove and the entire lower contact surface 45, or parts thereof, while the subsequent partial tool or tools form the rest of the strip 6 and its locking element 8.

In a second manufacturing step, the rest of the tongue groove 38 and the entire contact surface 43 are formed by means of a chip-removing tool V2, whose chip-removing surface portions (shown in FIG. 8) are moved into chip-removing engagement with the first joint portion 4*a* in a plane which is essentially parallel with a plane containing the upper side 2 of the floorboard. The insertion of this tool V2 thus takes place parallel with the upper side 3 of the floorboard, and the working takes place in levels between the upper side of the locking element 8 and the upper side of the floorboard.

The preferred manufacturing method is most suitable for rotating milling tools, but the joint system can be manufactured in many other ways using a plurality of tools which each operate at different angles and in different planes.

By the forming of the tongue groove being divided into two steps and being carried out using two tools, V1 and V2, it has become possible to position the lower contact surface 45 at a level below the upper side of the locking element. Moreover, this manufacturing method makes it possible to position the tongue and the tongue groove eccentrically in the floorboard and form the tongue and the tongue groove with a greater thickness in the thickness direction of the floorboard than has been possible up to now in the manufacture of floorboards, in which the strip is integrated with and preferably monolithic with the rest of the floorboard. The invention can be used for floorboards where the main portion of the board and the joint edge portions of the board are of the same composition, as well as for floorboards where the joint edge portions are made of another material but are integrated with the board before the chip-removing working to form the different parts of the locking system.

A plurality of variants of the invention are feasible. The joint system can be made with a number of different joint geometries, where some or all of the above parameters are different, especially when the purpose is to prioritise a certain property over the other properties.

The owner has contemplated and tested a number of variants based on that stated above.

The height of the locking element and the angle of the surfaces can be varied. Nor is it necessary for the locking surface of the locking groove and the locking surface of the locking element to have the same inclination. The thickness of the strip may vary over its width perpendicular to the joint plane F, and in particular the strip can be thinner in the vicinity of the locking element. Also the thickness of the board between the joint plane F and the locking groove 14 may vary. The vertical and horizontal joint can be made with a play between all surfaces which are not operative in the locking system, so that the friction in connection with displacement parallel with the joint edge is reduced and so that mounting is thus facilitated. The depth of the tongue groove can be made very small, and also with a tongue groove depth of less than 1 mm, sufficient strength can be achieved with a rigid thick tongue.

FIGS. 9*a-d* show some examples of other embodiments of the invention. Those parts of the tongue groove and the strip which are positioned below the marked horizontal plane H, are preferably made by means of an angled tool (corresponding to the tool V1), while those parts of the tongue groove which are positioned above this horizontal plane are made by means of a horizontally operating tool (corresponding to the tool V2).

Figure 9A:
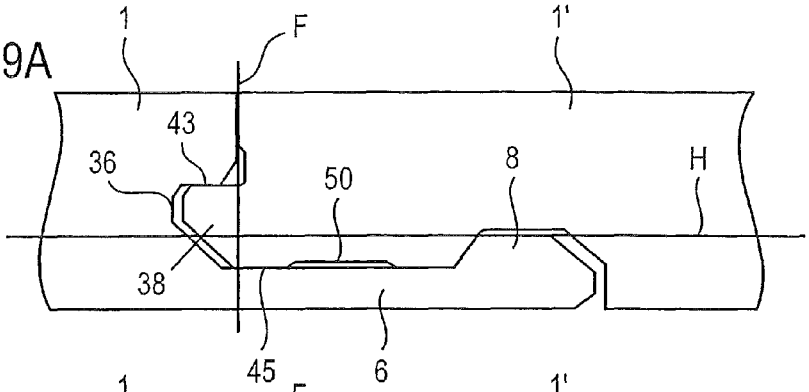
FIGS. 9*a-d* show variants of a floorboard and a locking system according to the present invention.

FIG. 9*a* shows an embodiment where the lower contact surface 45 is essentially outside the joint plane F and a very small part of the contact surface is inside the joint plane F. Between the tongue 38 and the locking groove 14 there is a recess 50 in the underside of the tongue. This recess serves to reduce the friction between the tongue and the strip 6 when displacing the adjoining floorboards 1, 1' along the joint plane F in connection with the laying of the boards.

Figure 9B:
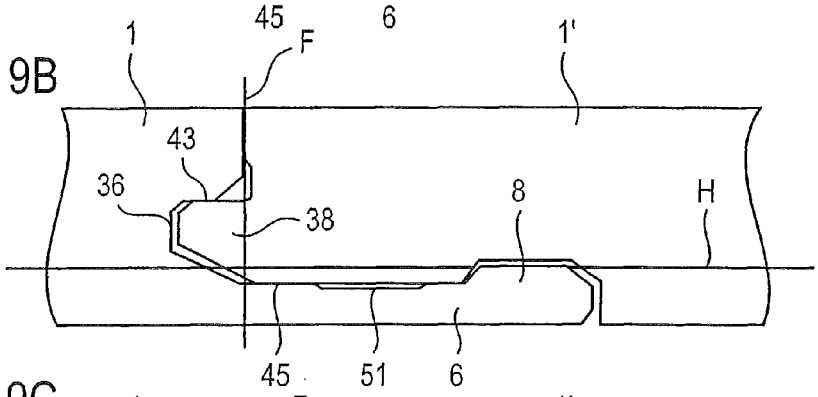

FIG. 9*b* shows an embodiment where the lower contact surface 45 is positioned completely outside the joint plane F. For reducing the friction, a recess 51 has in this case been formed in the upper side of the strip 6, while the contact surface 45 of the locking tongue is kept plane. The locking element 8 has been made somewhat lower, which makes the locking system particularly suitable for joining of short sides by snap action. The recess 51 in the strip 6 also reduces the rigidity of the strip and thus facilitates the joining by snap action.

Figure 9C:
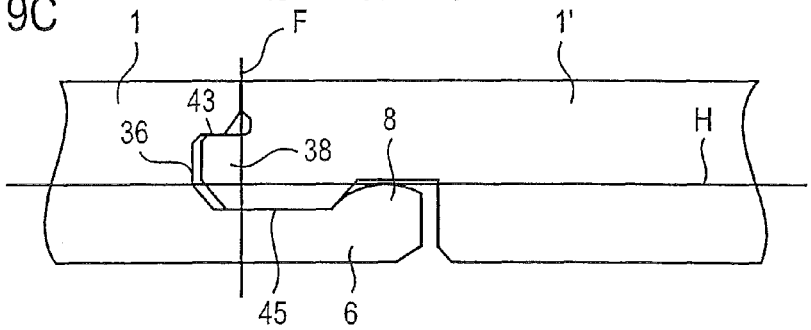

FIG. 9*c* shows an embodiment with a centrically positioned tongue 38 and a short rigid strip 6 where the lower plane contact surface 45 constitutes the upper side of the strip and is largely positioned outside the joint plane F. Just like in the other embodiments according to the invention, the lower contact surface 45 is positioned in a plane below the upper side of the locking element 8, i.e. below the marked horizontal plane H.

Figure 9D:
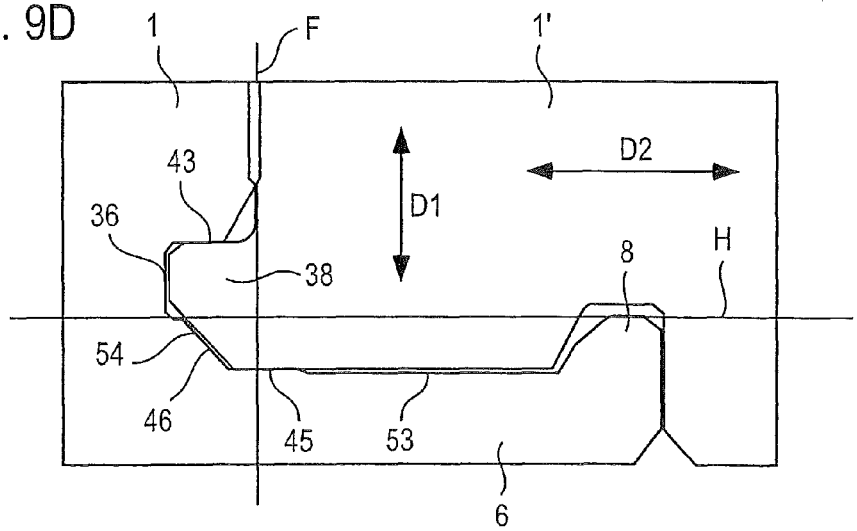

FIG. 9*d* shows an embodiment with a stable locking system. Locking in the vertical direction (D1 direction) takes place by means of upper and lower contact surfaces 43 and 45 respectively, of which the lower extend merely a short distance from the joint plane F. The portions of the strip outside the lower contact surface 45 up to the locking element have been lowered by forming a recess 53 and therefore they do not make contact with the adjoining floorboard 1'. This means a reduction of the friction when displacing adjoining floorboards in the direction of the joint plane F during the laying of the boards. The example according to FIG. 9*d* also shows that the demands placed on the surface portions of the tongue groove 36 furthest away from the joint plane F need not be very high, except that there should be a play 46 between these surface portions and the corresponding surface portions of the tongue 38. The Figure also shows that the working with the tool V2 can be carried out to a greater depth than would result in a straight inclined surface 54 which extends with the same inclination above the horizontal plane H.

The invention claimed is:

1. A floor board including an upper surface layer, a body layer arranged beneath the upper surface layer, a lower balancing layer, and a mechanical locking system for locking a first edge of the floor board to a second edge of an identical second floor board at a vertical joint plane located at upper joint edge portions perpendicular to a horizontal plane, the mechanical locking system comprising:

the first edge and the second edge together including a tongue and a groove forming a part of a first mechanical connection for locking the first and second edges to each other in a first direction at right angles to a principal plane of the floor boards, the tongue and groove being formed in the material of the body layer, the tongue having an end configured for insertion into the groove, the end constituting the innermost portion of the tongue that is furthest away from the vertical joint plane, the groove has an upper groove part, a lower groove part, an inner groove part and a groove opening at the vertical joint plane and extends horizontally between the vertical joint plane and the inner groove part; and a locking device arranged on an underside of the first and the second edges, the locking device forming a second mechanical connection locking the first and the second edges to each other in a second direction parallel to the principal plane and at right angles to the edges, wherein the locking device includes a locking groove which extends parallel to and spaced from the second edge, the locking groove being open at the underside of the second edge and including an internal surface, wherein the locking device further includes a strip formed from the body layer and the balancing layer extending from the first edge, the strip extending throughout substantially an entire length of the first edge and being provided with a locking element projecting from the strip, wherein the strip, the locking element, and the locking groove are configured such that when the second edge is pressed against an upper part of the first edge and is then angled down, the locking element can enter the locking groove, wherein the locking element has a locking surface which faces the first edge and is configured so as to contact the internal surface of the locking groove to prevent substantial separation of the joined first and second edges, wherein the tongue and the tongue groove have upper contact surfaces, wherein an upper edge of the locking element is located in a horizontal plane, which horizontal plane is positioned below the upper contact surfaces of the first mechanical connection and above the lower groove part, wherein the tongue and tongue groove are configured such that a gap is provided between the end of the tongue and the inner part of the groove and/or between a lower part of the tongue and the lower groove part.

2. The floorboard of claim 1, wherein the gap extends from the end of the tongue to the vertical joint plane.

3. The floorboard of claim 1, wherein the body layer is fiberboard.

4. The floorboard of claim 3, wherein there is a bevel formed on the upper part of the groove.

5. The floorboard of claim 4, wherein there is a gap between the outer end of the locking element and the locking groove.

6. The floorboard of claim 5, wherein there is a gap between upper side of the locking element and the bottom of the locking groove.

7. The floorboard of claim 1, wherein the upper contact surfaces are essentially plane-parallel and extend essentially parallel with a plane containing the upper side of the floor board.

8. The floorboard of claim 1, wherein the horizontal plane of the upper edge of the locking element is positioned closer to the lower groove part than to the upper contact surfaces.

9. The floorboard of claim 1, wherein the strip, the locking element, and the locking groove are configured such that when the second edge is pressed against the first edge horizontally the locking element can enter the locking groove with a snap action.

* * * * *